United States Patent [19]

Burkey et al.

[11] 4,183,977

[45] Jan. 15, 1980

[54] METHOD OF AUTO-GLAZING WOOD

[75] Inventors: David J. Burkey, Millersville; Lawrence Clark, Lancaster, both of Pa.

[73] Assignee: Armstrong Cork Company, Lancaster, Pa.

[21] Appl. No.: 938,825

[22] Filed: Sep. 1, 1978

[51] Int. Cl.[2] ..... B05D 3/12; B05D 5/00

[52] U.S. Cl. ..... 427/199; 101/28; 427/274; 427/275

[58] Field of Search ..... 427/262, 264, 274, 275, 427/199; 428/151, 156, 195; 101/28

[56] References Cited

U.S. PATENT DOCUMENTS 3,536,574 10/1970 Buckley ..... 428/151

*Primary Examiner*—Evan K. Lawrence

[57] ABSTRACT

The invention is directed to a method of embossing a wood grain pattern on a composition board surface to provide it with a grain detail such that auto-glazing may be carried out. Auto-glazing is automatically providing variable amounts of glazing on a wood surface to highlight the grain pattern of the wood.

1 Claim, 3 Drawing Figures

METHOD OF AUTO-GLAZING WOOD

BACKGROUND OF THE INVENTION

1. Field of the Invention

The invention is directed to a method of decorating a wood grain surface and, more particularly, a technique for providing automatic highlighting of the wood grain pattern.

2. Description of the Prior Art

It is old in the art to make embossing plates which will provide a wood grain pattern to a fiberboard surface. The wood grain surface normally has applied thereto a glaze, which is a dark, relatively viscous coating that is applied by spraying and then removed by hand wiping. During removal of the glaze, a trained finisher will be sure to leave a certain amount of glaze on areas of the surface while wiping other areas relatively clean. This is done to highlight the grain pattern of the wood. Naturally, it requires an individual who has a relatively high level of skill to carry out the highlighting. This is one big reason why furniture finishing has resisted automation; and, therefore, furniture finishing must be done by costly hand labor.

SUMMARY OF THE INVENTION

The invention is directed to a method of decorating a wood grain surface comprising the steps of embossing a wood grain detail on a composition board (particleboard or fiberboard) surface. In the finishing operation for that embossed surface, a glazed coating is provided to the fiberboard surface. The invention of this application is not only the embossing of a wood grain pattern on a fiberboard surface, but the embossing of selected rough areas on the fiberboard surface. The embossing plate at selected areas is sprayed with metal particles which cause a roughened surface on the embossed fiberboard surface. This roughened surface then acts as pockets to hold the glaze coating. Therefore, when the glaze coating is now uniformly wiped off from the wood fiber surface, not only does the glaze stick in the grain lines embossed in the fiberboard surface, it also sticks in the roughened surface of the fiberboard surface and provides areas which contain glazing as compared to other areas which have virtually no glazing due to the relatively smooth nature of the fiberboard surface. This, then, provides an automatic glazing or highlighting of the grain pattern of the fiberboard surface.

DESCRIPTION OF THE PREFERRED EMBODIMENT

Figure 1:
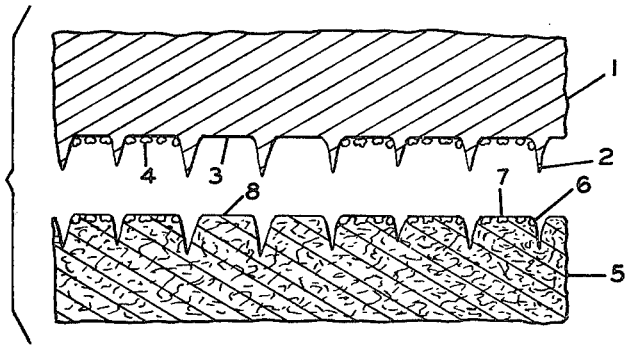
FIG. 1 is an end view of an embossing plate and an embossed material.

One of the steps in the conventional finishing of furniture is the application of a glaze. Glaze is normally a dark, relatively viscous coating that is applied by spraying and then removed by hand wiping. During removal, a trained finisher will be sure to leave a certain amount of glaze on areas of the surface while wiping other areas relatively clean. This is done to highlight the natural grain pattern of the wood employed. In real wood veneers, each surface is unique, and, therefore, the glaze pattern is unique. This is why this aspect of furniture finishing has resisted automation and, even though it is costly, it is still done by hand.

When embossing grain details or other visual details on a fiberboard surface, the areas to be highlighted remain constant from one surface to another. By including certain surface effects in the embossing plate, it is possible to provide for an automatic glazing effect. The surface effects are provided to the embossing plate by roughening selected areas of the embossing plate so that they thus provide pockets or depressions in corresponding areas of the fiberboard surface. Now the glazing will tend to remain the these pockets during a uniform wiping of the fiberboard surface. This, then, results in the roughened surfaces of the fiberboard surface retaining glazing while the smooth surfaces of the fiberboard surface will be wiped relatively clean. Naturally, the total board is provided with a graining, and the glaze will stay in the graining. The roughening of the board's surface primarily occurs in the areas between the grain lines.

Referring now to the Figures, there is shown the embossing plate 1 positioned above embossed material 5 which has been embossed with the pattern of the embossing plate. The embossing plate has raised areas 2 which form the wood grain lines in the embossed material. The embossing plate also has flat areas 3. Some of the flat areas 3 have been provided with little particles of metal 4. The embossed material 5 is provided with grain lines 6 made by the embossing lines 2. The flat areas 3 provide the smooth raised areas 8 between the grain lines. The little particles of metal 4 cause indentations 7 in some of the raised areas 8.

Figure 2:
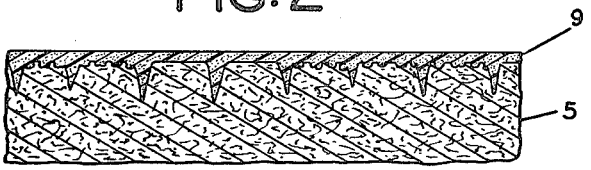
FIG. 2 is an end view of an embossable material covered with a glaze coating.
Figure 3:
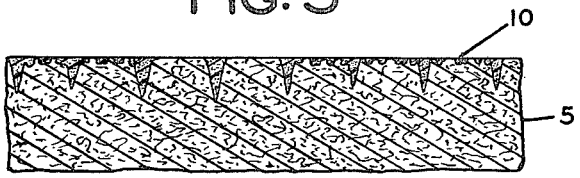
FIG. 3 is an end view of an embossable material that has had the surface wiped to remove some glaze coating.

The embossed material is then provided with a glaze coating 9 which covers the whole surface of the embossed material 5, as shown in FIG. 2. FIG. 3 is a representation of the embossed material 5 after the glaze coating has been wiped. The wiping action removes the glaze coating from all the raised areas and leaves the glaze material only in the depressed areas. These depressed areas are the grain lines and the indentations 7 which were provided on the embossed material. The glaze material retained in these depressions is element 10 of FIG. 3. The glaze coating thus provides for an automatic highlighting in those areas which contained the depressions 7 while those areas not containing the depressions 7 are wiped relatively clean of the glaze material.

A metal embossing plate is made in the conventional manner as in known in the art. This is provided with the conventional wood grain effect one desires to provide to the fiberboard surface. The embosssing plate is then masked in selected areas through the use of a metal tape. Those areas which are to be treated for highlighting are left exposed, and those areas which are not to be treated for highlighting are covered by the metal tape. The embossing plate, which can be a nickel plate, is then preheated to 400°–450° F. using an acetylene torch which is an integral part of the Roto-tec gun, Model II, which is a metal spray gun produced by the Eutectic Company. As soon as the embossing plate is preheated, metallical particles are sprayed out from the Roto-tec gun and deposited on the nickel embossing plate. Very good results are secured using the Roto-tec gun with the Ultrabond 25,000 powder produced by Eutectic Company. This, then, provides on one pass a deposition of particles on selected portions of the nickel embossing plate, with the particles ranging in size from ¼–1 mil in diameter to ¼–1 mil high. The particles will be randomly spaced approximately ½–1 mil apart. Clearly, the particles are placed on the nickel plate to secure a splatter or rain-spot effect.

The metal masking tape is then removed from the embossing plate, and the embossing plate is used in a conventional manner to provide a wood grain effect to a particleboard surface that does not have any particular grain effect. The invention is particularly useful with conventional base coated particleboard such as the 45 lbs./cu. ft. particleboard produced by the Boise Cascade Company. It is now possible to provide this particleboard, which has no surface graining at all, with a surface graining that may look like oak.

There is then applied to this surface a glaze coating which is a standard furniture finishing material produced by the Mobil Company. This is sprayed on the embossed wood surface in a conventional manner and permitted to dry for 1–5 minutes. Actually, the coating does not really dry, but tends to gel to a slight extent. One now takes a rag and uniformly wipes off the embossed surface. Glaze compound will be retained in the depressed areas which define the wood grain. Glaze compound will also be retained to a lesser degree in the roughened surface of the board which resulted from the forming of indentations in the board because of the presence of the particles sprayed upon the embossing surface. Consequently, in some areas of the board, glazing will be retained in only the grain depressed areas of the board with the raised areas between the grain depressed areas are wiped relatively clean because the surface there is relatively smooth. However, in other areas of the board, the metal particles on the embossing plate have provided these areas between grain lines with dimples or a roughened surface, and the glaze compound will be retained in these areas and provide a high-lighting or darkening of these areas as compared to the unroughened areas. Consequently, there is now provided an automatic highlighting of the board which eliminates the need for a skilled finisher.

What is claimed is:

1. A method of decorating a wood grain surface comprising the steps of:

(a) embossing a wood grain detail on a fiberboard surface with an embossing plate to produce a indented line pattern with raised areas therebetween, (b) at least finishing the embossed surface with a glaze coating, and (c) the improvement comprising:

(1) depositing in selected areas of the embossing plate, prior to step (a), primarily in the areas of the plate corresponding to said raised areas of the fiberboard, a spray of metal particles to cause a roughened embossing surface in those selected areas so that when embossing step (a) is carried out, there will be a roughening of some of the raised areas of the embossed surface, and (2) after the glaze coating is applied, uniformly wiping the embossed surface to remove most of the coating from the raised areas of the wood grain detail, leaving the glaze coating in greater concentrations in the selected areas of the wood grain detail which have been roughened by the selected areas of the embossing plate that were treated by the spray of metal particles, whereby the raised surfaces of the wood grain detail which have not been roughened will be wiped relatively clean of glaze while the roughened surfaces of the wood grain detail will retain more glazing than the non-roughened areas.

* * * * *